United States Patent [19]

Braunschweiler

[11] 3,961,498

[45] June 8, 1976

[54] MACHINE FOR PRODUCING CIRCULAR TEXTILE WEBS

[75] Inventor: Hans Georg Braunschweiler, Winterthur, Switzerland

[73] Assignee: Uniroyal Inc., New York, N.Y.

[22] Filed: Apr. 14, 1975

[21] Appl. No.: 567,994

Related U.S. Application Data

[63] Continuation of Ser. No. 427,498, Dec. 26, 1973.

[30] Foreign Application Priority Data

Jan. 5, 1973 Switzerland ..... 91/73

[52] U.S. Cl. ..... 66/13; 66/17; 66/190

[51] Int. Cl.[2] ..... D04B 9/12

[58] Field of Search ..... 66/13, 10, 190, 19, 66/17; 139/14, 13, 1, 383 B

[56] References Cited

UNITED STATES PATENTS

| | | | |
|---|---|---|---|
| 427,929 | 5/1890 | Stowe | 139/383 B |
| 537,317 | 4/1895 | Stowe | 139/1 |
| 1,932,151 | 10/1933 | Welffens | 66/10 |
| 3,709,262 | 1/1973 | Braunschweller | 139/14 |
| 3,884,053 | 5/1975 | Niederer | 66/190 |
| 7,324,434 | 6/1903 | Nicholls | 66/10 |

*Primary Examiner*—Ronald Feldbaum
*Attorney, Agent, or Firm*—Jay L. Chaskin

[57] ABSTRACT

The invention covers a machine for producing textile webs wherein a circular weaving-knitting system is produced with the knitting portion of the system having a single or double needle operation to form a textile having selectively arranged weft insertions and courses.

7 Claims, 25 Drawing Figures

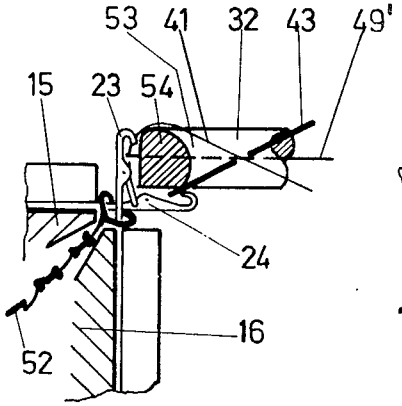
Fig. 3
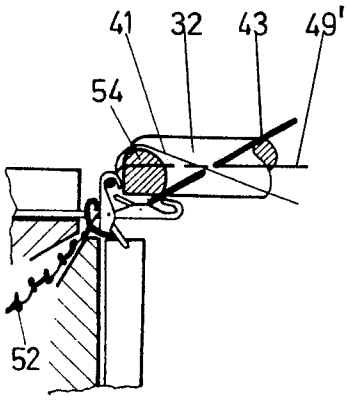
Fig. 4
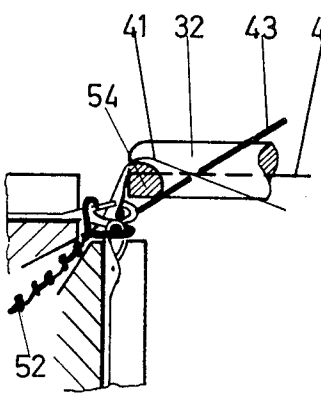
Fig. 5
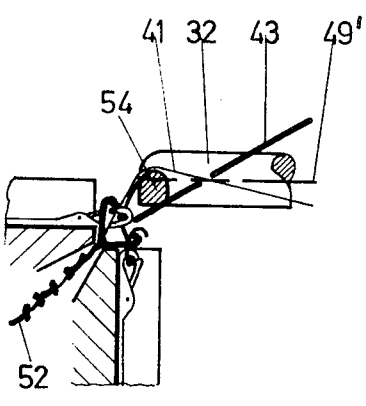
Fig. 6
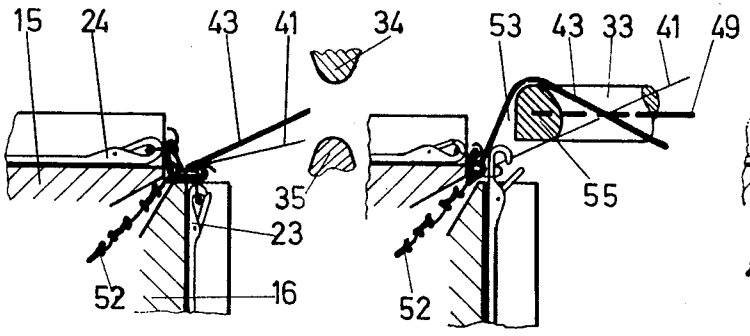
Fig. 7
Fig. 8
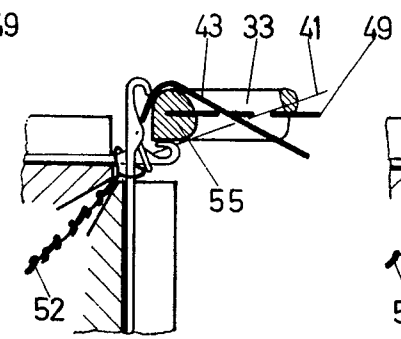
Fig. 9
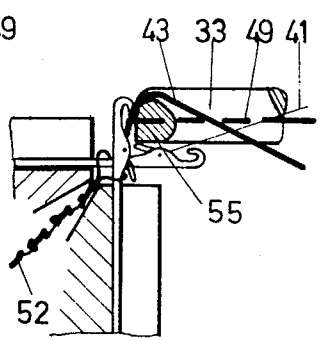
Fig. 10

CHANGE OF SHED

LIFT NEEDLES, FORM NEW STITCHES

FIG. 12A
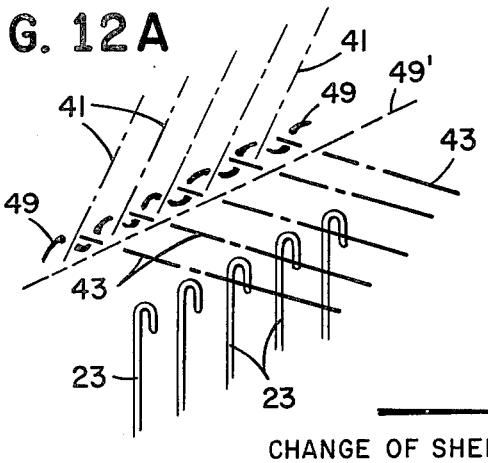
FIG. 12B
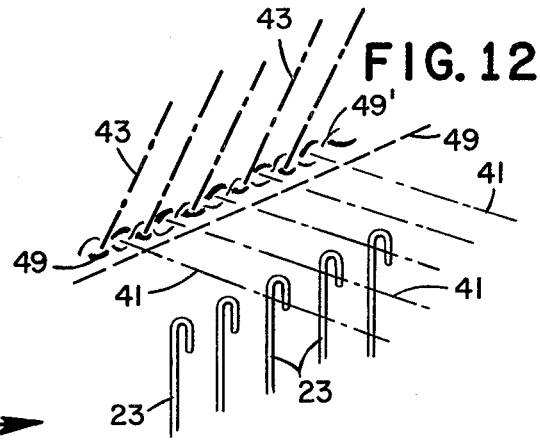
CHANGE OF SHED, NEEDLES KEEP LOW POSITION:
NO NEW STITCHES - BUT WEFT
PREVIOUS STITCHES - NOT SHOWN -
FIG. 15
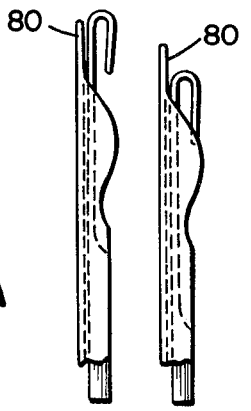
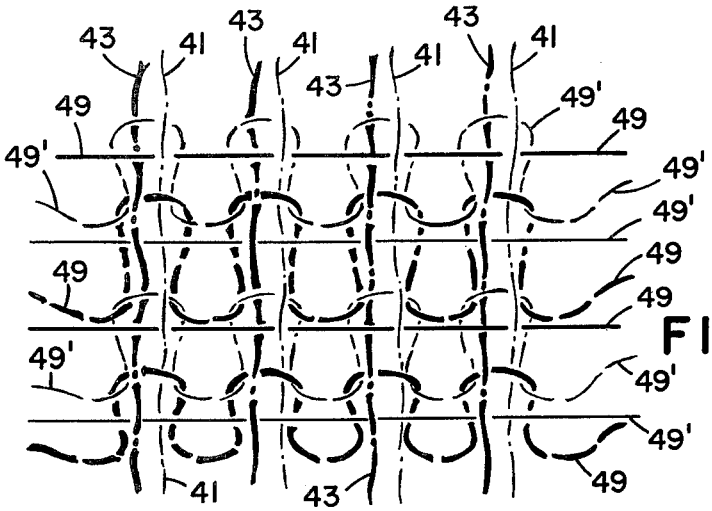
FIG. 14A
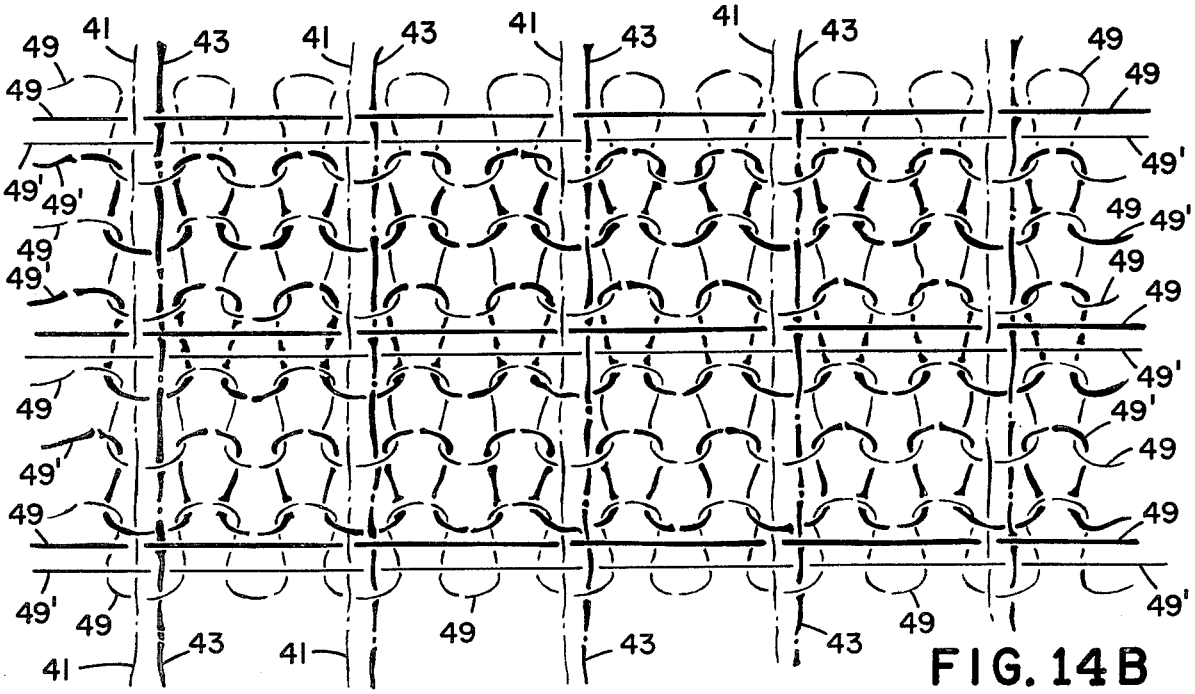
FIG. 14B

MACHINE FOR PRODUCING CIRCULAR TEXTILE WEBS

This is a continuation of U.S. Pat. Application Ser. No. 427,498 filed Dec. 26, 1973.

BACKGROUND OF THE INVENTION

A method and apparatus for producing textile webs representing a combination of meshed fabric and knitted fabric are known (Article in Zeitschrift fur die gesamte Textilindustrie "Chemiefasern 20" of July 1970) wherein, in order to obtain a simple form of shedding warp movement, a flat knitting machine is modified and also provided with a gripper in order to permit the insertion of both weft yarns to be meshed and straight weft yarns in the shed formed. However, it has been found that the production speed of this combined machine does not meet the requirements of industrial use, partly for mechanical reasons (weaving portion slower than knitting portion) and by the large number of loop yarns required (analogous to weft yarns when weaving).

A multiphase circular weaving system is shown and described in Swiss Pat. No. 522,058 and its U.S. counterpart U.S. Pat. No. 3,709,262, which is incorporated by reference herein, in which a circular weaving mechanism having two supply devices, each of which supplies a group of warp yarns, are circularly arranged along a closed curve. The supply device for one group of warp yarns has separate storage members between which the warp yarns of the other group are passed. On both sides of the warp yarns parallel to the closed curve are arranged holders with weft yarn bobbins. These holders rotate around an axis of a circular weaving line. In the area of each of the individual weft yarn bobbins is provided a yarn guide or insertion frame or bow for the removal of the weft yarn from the bobbin whereby the yarn insertion bow engages helically over the set of storage members of the one group of warp yarns, and by deflecting the warp yarns of the other group forms the shed in which are inserted the weft yarns released by the yarn bow to produce a lay-in or weft insertion. The described circular weaving machine makes it possible to produce fabrics with linen weave as well as other types of weaves provided the sequence of warp yarns of the first and second groups of warp yarns and the sequence of the successively acting yarn insertion bows are accordingly modified.

Circular knitting machines of the most varied construction and type with varied knitting systems are known for producing meshed fabrics, in particular knitted fabrics, whereby the conventional circular knitting machines frequently have two needle beds in the form of a needle cylinder and a height-adjustable dial plate wherein, on the one hand, are guided the cylinder needles, and on the other the dial needles which are operated by appropriate dial frogs. Such circular knitting machines provide a relatively high productivity and smooth running.

SUMMARY OF THE INVENTION

This invention provides a machine arrangement or system for producing textile webs which combine the properties of the woven fabric, e.g. good dimensional stability, with those of meshed fabrics, e.g. high elasticity, whereby the operation of the weaving portion of the system does not impede the operation of the knitting portion so that the higher knitting productivity is maintained combined with weaving.

The machine for producing textile webs according to the invention is characterized in that a circular weaving portion having two fixed groups of separate warp yarn storage members or means, each supplying a group of warp yarns radially to a circular weaving line and cooperatively arranged in a closed curve, upper and lower weft yarn bobbins or means with associated weft yarn insertion bows or insertion frames arranged parallel to the closed curve and fixed on rotary support members, is combined with a knitting portion having a fixed dial, a rotating dial frog portion and/or a fixed needle cylinder with rotating cylinder frog portion.

The circular weaving line of the weaving portion of the machine is described by the outlets of the rotating insertion frames or bows and coincides with the circular knitting line of the knitting portion formed by the dial and cylinder needles operated by means of the corresponding frog portions, thereby forming a common circular weaving-knitting line, with the weft yarns inserted alternately by the upper and lower insertion bows as they form sheds with the inserted yarns formed into meshes as desired by the selectively controllable engagement of the dial and cylinder needles, by the synchronization of the drives of the rotary parts of both the weaving portion and the knitting portion of the machine. Thus there is produced a machine that will form in a single function a combined weaving and knitting operation so that fabric is produced having conventional weaving integrated with knitting in an easy and simplified manner.

BRIEF DESCRIPTION OF THE DRAWINGS

These and other objects and advantages will become apparent from the hereinafter described embodiments of the machine according to the invention and will be explained in detail relative to the drawings, in which:

FIGS. 3 through 10 are representations of successive needle and weft yarn insertion bow positions of the circular weaving-knitting machine shown in FIG. 1;

FIGS. 12A and B show a representation of the position of the needles during weft insertion so as to produce plain weaving;

FIGS. 14A and B show two possible fabrics produced by operation of the combined knitting-weaving machine of this invention; and FIG. 15 shows a modified compound needle.

DESCRIPTION OF PREFERRED EMBODIMENTS

Figure 1:
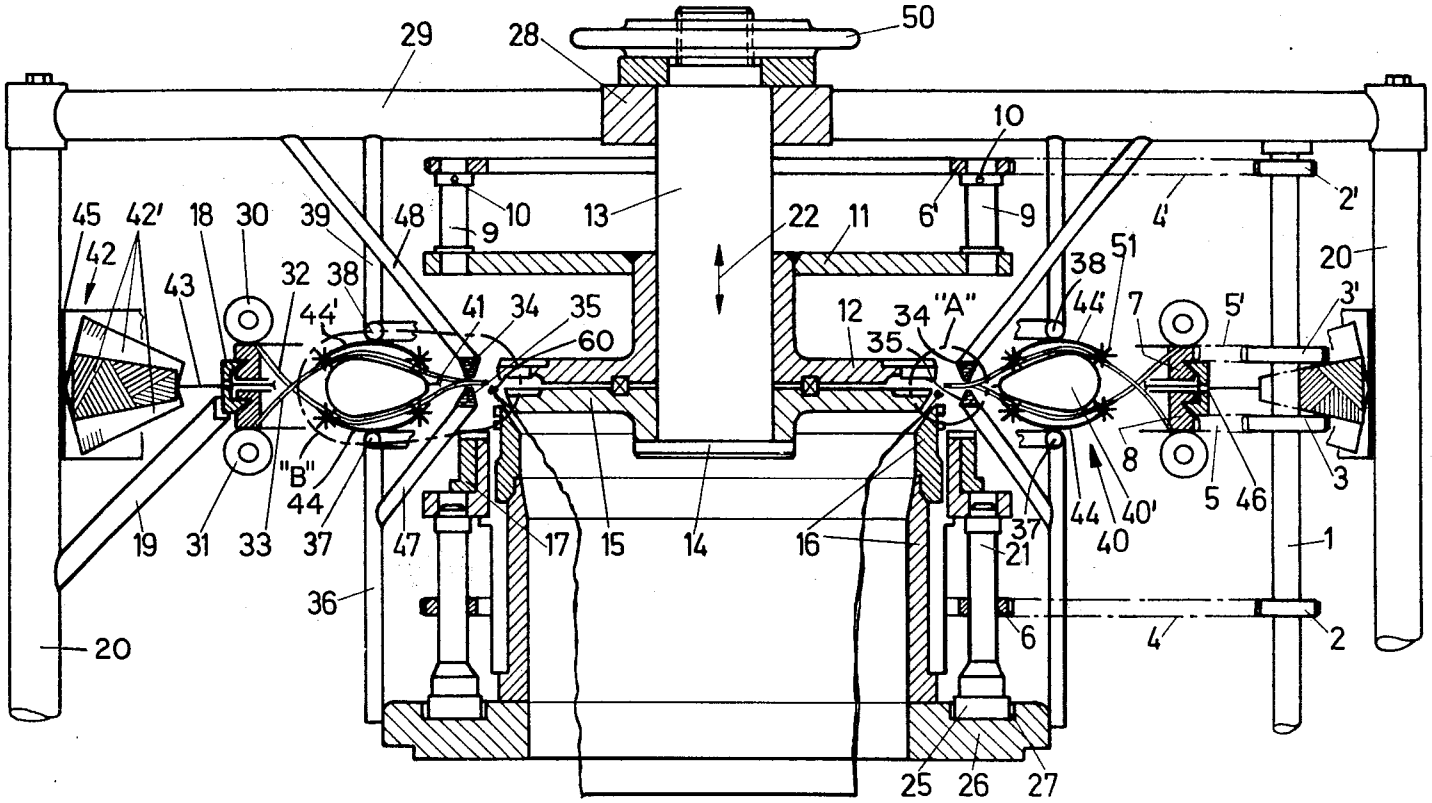
FIG. 1 shows a schematic view of the circular weaving-knitting machine of this invention with the weaving portion and the knitting portion presented in cross-section.

In the section through the upper portion of the circular weaving-knitting machine of this invention resting on supports 20, can be seen a main drive shaft 1 driven by a conventional driving means which operates on the one hand via toothed wheels 2,2', toothed belts 4,4', and toothed rings 6,6', a knitting portion, and on the other via toothed wheels 3,3', toothed belts 5,5', and toothed rings 7,8 a weaving portion.

The circular knitting portion of the machine comprises a circular flange 11 which is operatively connected with the toothed ring 6' via support members 9 and arranged in cage-like manner, whereby a circular flange 11 is rigidly connected with a frog carrier 12 both of which members 11 and 12 are mounted in a rotary manner on shaft 13. Shaft 13 is provided with a flange 14 with which engages a dial 15 rigidly connected with the shaft 13. In dial 15 are radially movably guided dial needles 24 (shown in FIG. 2), being controllable by frogs located in frog carrier 12. Circular flange 11, frog carrier 12, and dial 15 are adjustable in the direction of arrow 22 by shaft 13 guided in a hub 28 by turning a handwheel 50. Adjusting collars 10 are provided on support member 9 for compensating height differences so that the toothed ring 6' remains in the predetermined position adapted to toothed wheel 2'.

With respect to a fixed needle cylinder 16 wherein are axially movable the cylinder needles 23 (shown in FIG. 2) is provided a frog carrier 17 which operates cylinder needles 23. Cylinder 16 is surrounded by support members 21 arranged in cage-like manner connected on one side to the frog carrier 17 and on the other to a slide bearing ring 25, whereby frog carrier 17, support members 21, and bearing ring 25 are caused to rotate in an annular slot 27 of an annular plate 26 by the toothed ring 6.

The circular weaving portion of the machine of this invention is similar to the machine disclosed in Swiss Pat. No. 522,058 and its United States counterpart U.S. Pat. No. 3,709,262, and has in addition toothed rings 7 and 8 which are guided and supported by slide bearing segments 18 and driven in rotary manner by toothed wheels 3,3'. The slide bearing segments 18 are connected to the frame 20 by struts 19.

The rotary toothed ring 7 supports the upper weft yarn supply bobbins 30 and the rotary toothed ring 8 supports the lower weft yarn supply bobbins 31. From each supply bobbin 30 extends in a helical manner an insertion bow 32 to the needles 23, 24 at the weaving-knitting line 60, and from each supply bobbin 31 extends in a helical manner an insertion bow 33 to the needles 23, 24 at the weaving-knitting line 60. All insertion bows are held in position by means of guidance rings 34, 35, the bows having yarn outlets or openings 56 at their ends. At the outlets the yarn from the bobbins 30, 31 leaves the insertion bows 32, 33 in the sheds formed by the action of the bows, to be formed as weft or a course.

In the area between the toothed rings 7, 8 and guidance rings 34, 35 is provided storage members 40' arranged in a closed curve or an annular ring as a set of storage members 40, whereby each member supplies the inner warp yarn 41. In the embodiment the arrangement of the individual storage members 40' is such that one of the outer warp yarns 43 in each case passes between a pair of adjacent storage members 40'. The storage members 40' are located and held in place by associated holders 44, 44' fixed to rings 37, 38. Ring 37 with support 36 is fixed to annular plate 26 and ring 38 with support 39 to strut 29, whereby preferably both rings 37, 38 comprise tubes which form a closed curve. On each end of holders 44, 44' is mounted in rotary manner a vaned wheel 51 on and between whose vanes are located members 40'. On rotation of the insertion bows 32, 33, they pass through the gaps between the somewhat offset vanes of vaned wheels 51.

On support 20 is arranged a holder 45 which serves to support the warp yarn supply bobbins 42' in a fixed position, whereby each individual bobbin 42' supplies the outer warp yarn 43 which goes radially inward to the weaving-knitting line 60.

The machine operates as follows: The knitting portion as well as the weaving portion of the machine are operated at synchronized speeds by drive shaft 1. The dial-frog carrier 12 is driven by toothed ring 6' via support member 9 and annular flange 11. Cylinder-frog carrier 17 is driven by toothed ring 6 via support members 21 arranged in slide bearing ring 25. Since toothed rings 6, 6' are operatively connected to drive shaft 1, the frog carriers 12, 17 rotate at the same speed so that simultaneously dial needles 24 located in the fixed dial 15 and the cylinder needles 23 located in the also fixed cylinder 16 are operating in a synchronized manner.

Figure 2:
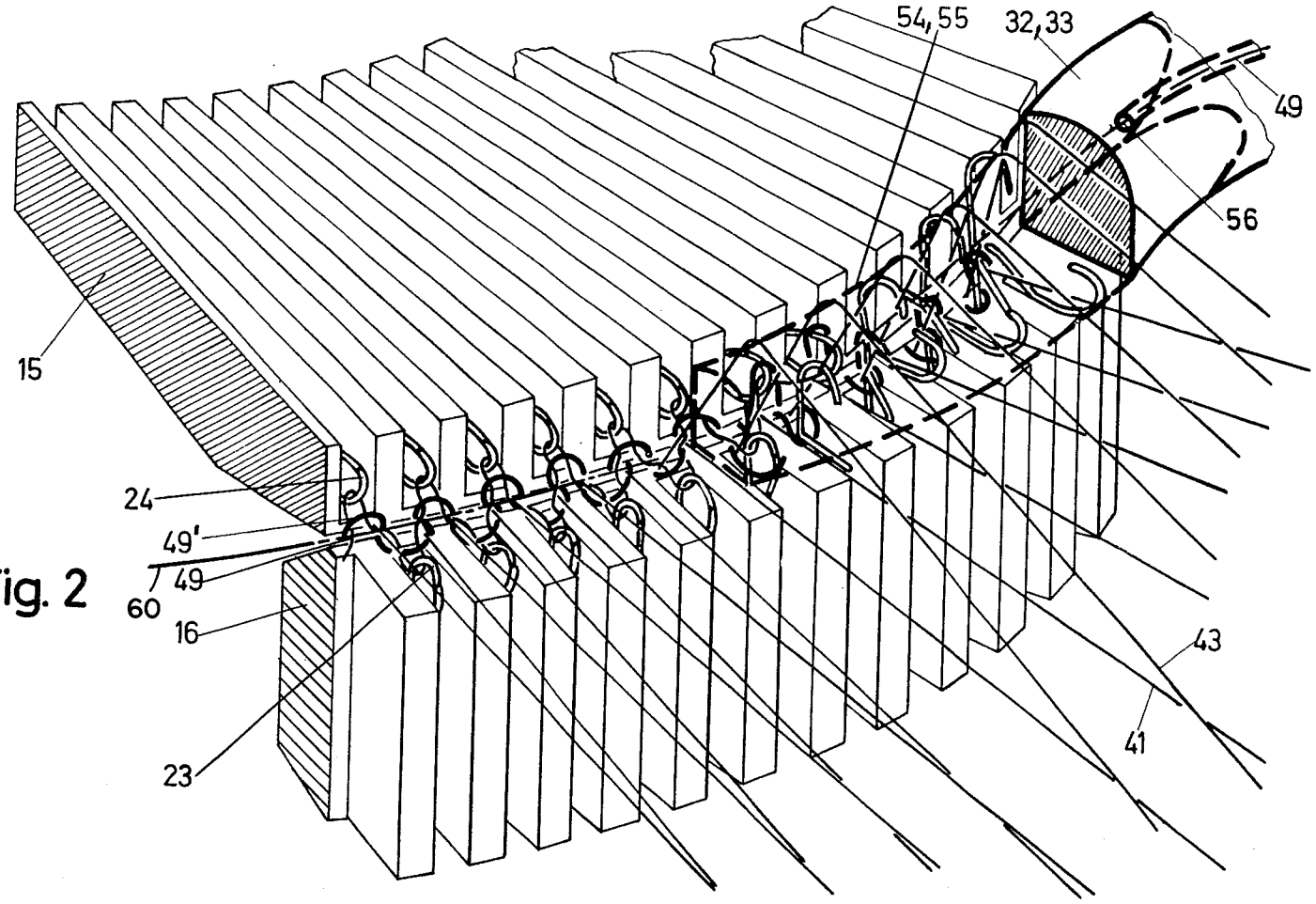
FIG. 2 is a perspective cutaway view showing a portion of the area contained within the circle A in FIG. 1 on an enlarged scale.
Figure 2A:
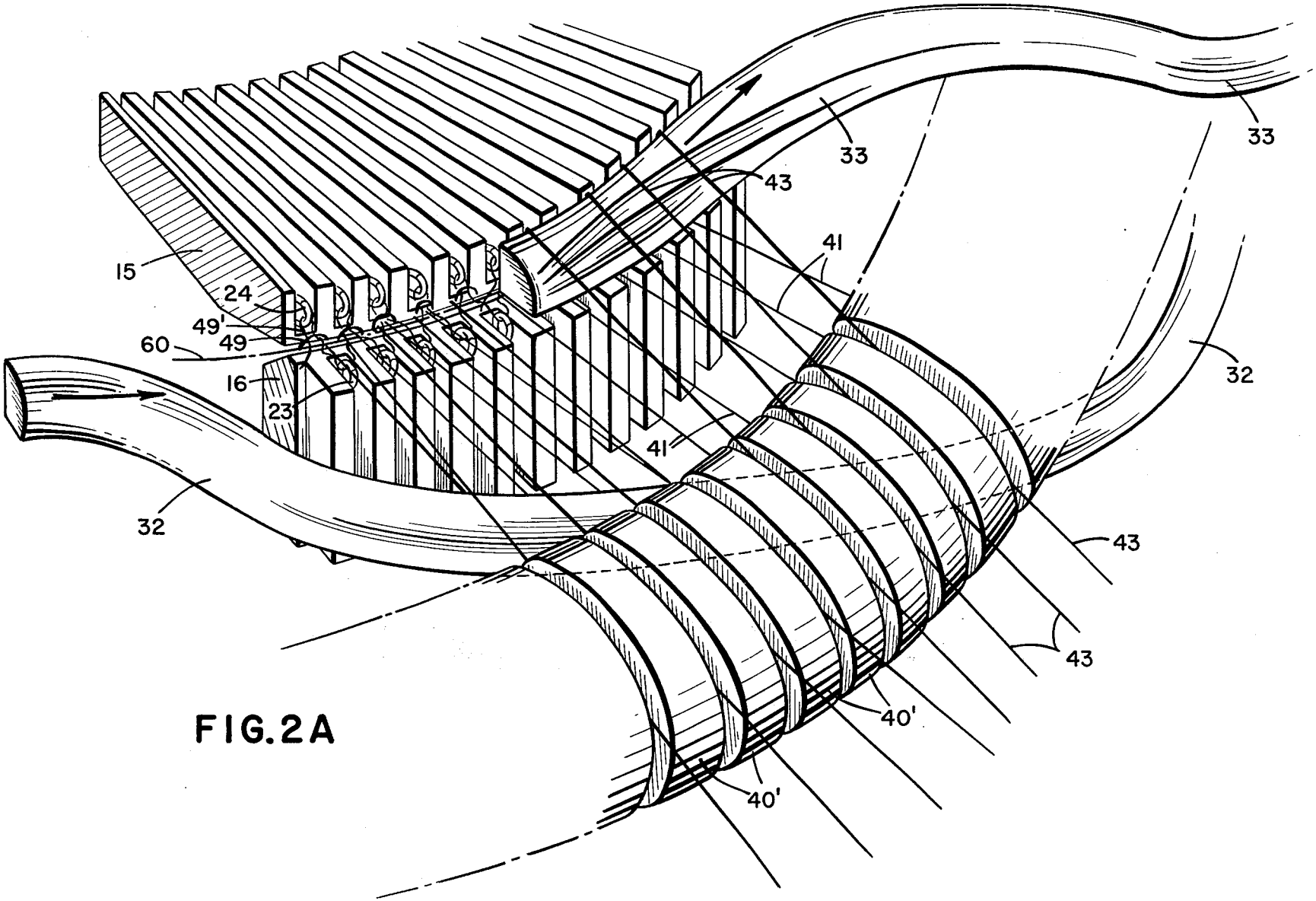
FIG. 2A shows a perspective cutaway view schematically of a portion of the area within the enclosed oval B in FIG. 1, on an enlarged scale.

The weft yarn bobbins 30, 31 which are fixed to toothed rings 7, 8 driven in rotary manner by shaft 1 are synchronized to the dial frog carrier 12 and the cylinder frog carrier 17. The weft yarns 49, 49' pass through the insertion bows 32, 33, respectively, and remove yarn from bobbins 30, 31 and supply it to the combined weaving-knitting lines (FIGS. 1 and 2).

The insertion bows which extend away from the bobbins in ray-shaped manner embrace sequentially in tandem and with reference to the rotation direction from above and below the toroidally or annularly arranged set of supply members 40'.

From the supply members 40', the individual warp yarns 41 are fed to the weaving-knitting line 60. Externally and around the toroidal arrangement of members 40' and toothed rings 7 and 8 is arranged the set of supply members 42 providing the outer warp yarns 43. Warp yarns 43 are passed through the openings, e.g. in the form of holes 46 made in holders 18 and are then guided as the outer group of warp yarns in centripetal, i.e. ray-shaped manner.

Subsequently and successively the individual warp yarns 43 are moved downwardly by rotating the insertion bows 32 along the combined weaving-knitting line 60. Insertion bows 33 function in the opposite manner, i.e. they displace the individual warp yarns of group 43 upwards and space 53 is now formed on the other side of warp yarns 43. In both cases the yarns from bobbins 30, 31 are now deposited as weft yarn 49, 49' in the combined weaving-knitting line 60 which may be subsequently meshed corresponding to a particular control or pattern by the function of needles 23, 24, whereby the fabric 52 shown in FIGS. 3 through 10 is formed.

Figure 2B:
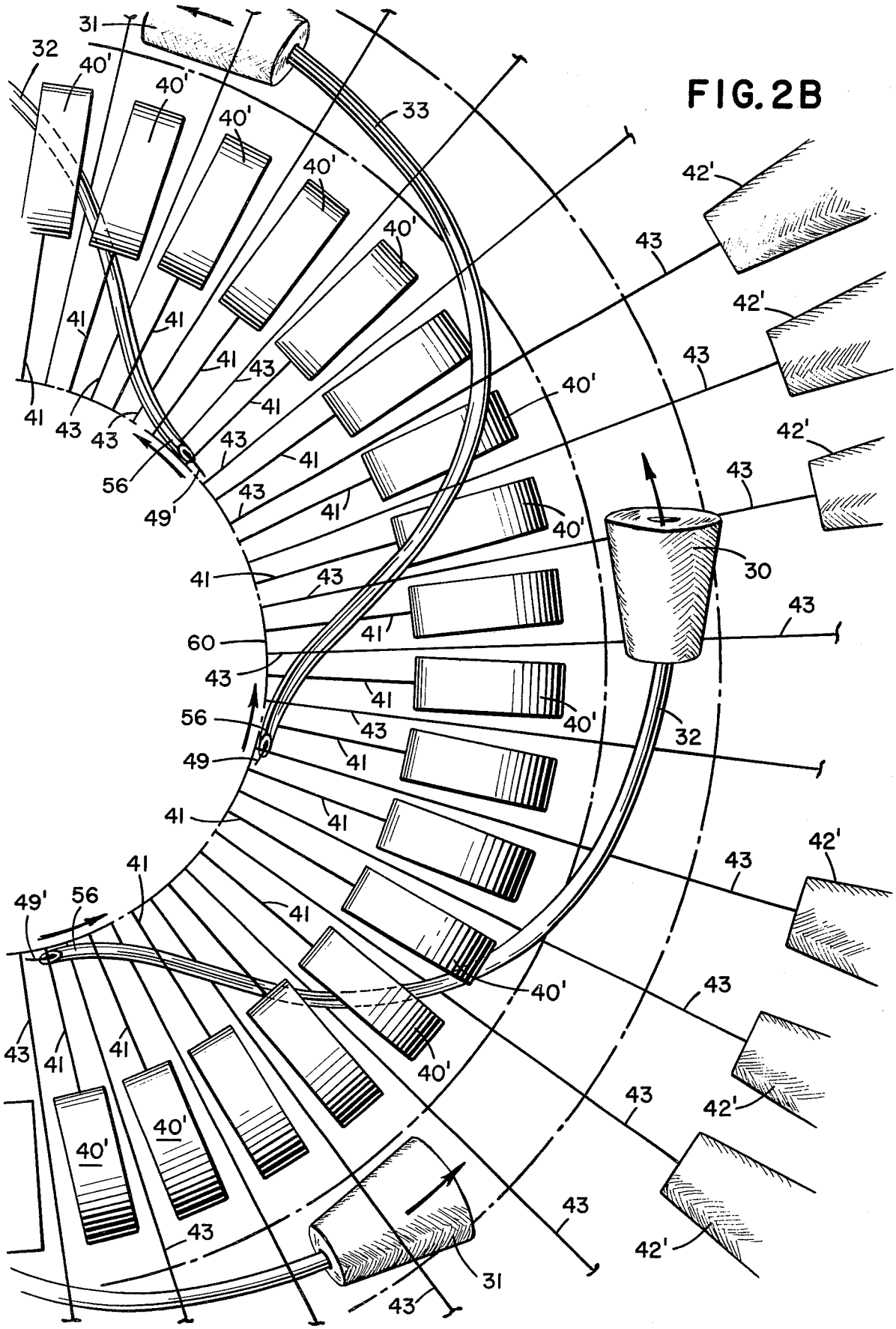
FIG. 2B shows a top plan view schematically of two successive insertion bows projecting helically from weft yarn supply bobbins around a set of warp yarn supply bobbins, one insertion bow projection from an upper weft yarn supply bobbin and the other from a lower weft yarn supply bobbin.

The indicated working processes take place successively, i.e. the following insertion bow can start forming a shed before the former insertion bow has laid-in the weft yarn. Viewed radially from outside in the direction of the center of the machine, the beginning of the following insertion bow passes before the end of the former insertion bow, see FIG. 2B.

In FIGS. 2 and 3 – 10, the dial and cylinder needles are constructed for example as latch needles 23, 24 for which the extension 54, 55 of the appropriate insertion bows 32, 33, shown in FIG. 2 require a construction according to FIGS. 3 through 6 and 8 through 10 in order to keep the shed open until the individual mesh is formed. The extension 54, 55 also has the function, as in circular knitting machine, of preventing a too early closing of the latch needles.

In a variant using modified compound needles shown in FIG. 15 the extension 54, 55 to the insertion bows merely has the function of keeping the shed open until the mesh is formed because such needles have no latches. The extension 80 must keep the warp threads in or between the same stitch wales.

Figure 11A:
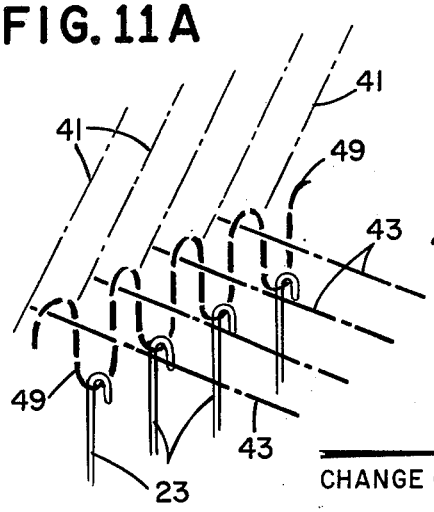
FIGS. 11A, B, and C show a representation of cylinder needles in action when the production of stitches from the inserted weft yarn is programmed.
Figure 11B:
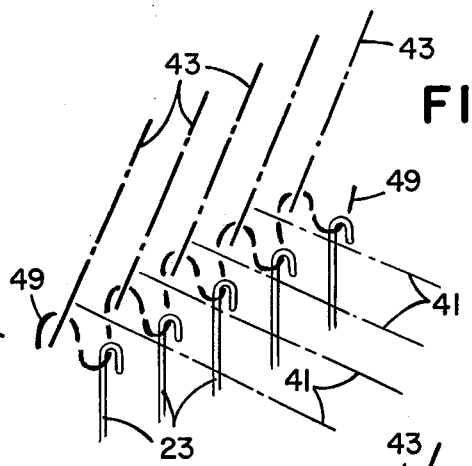
Figure 11C:
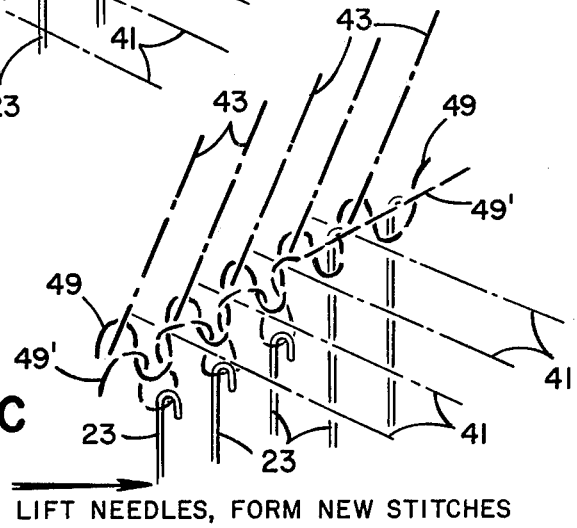
Figure 13A:
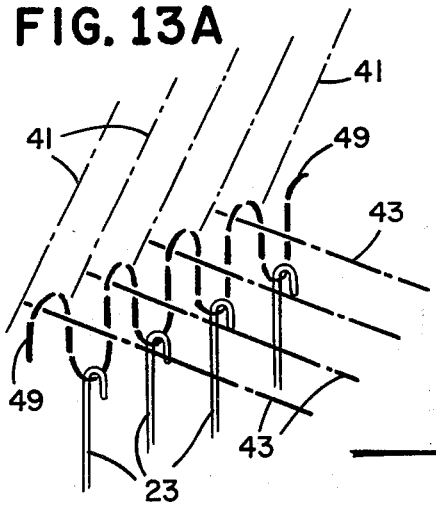
FIGS. 13A, B, and C show a representation of alternate operations of the weft yarn insertion to those illustrated in FIGS. 11A, B, and C and in FIGS. 12A and B.
Figure 13B:
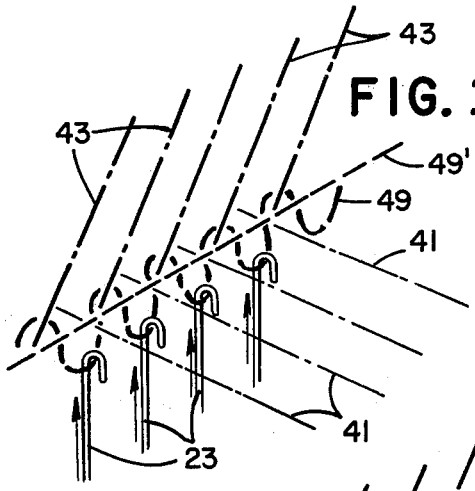
Figure 13C:
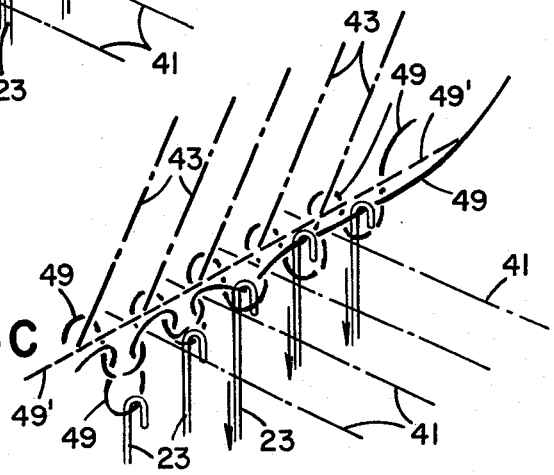

The produced fabric 52 fed downwardly contains both the warp yarns 41, 43 and the inserted weft yarns 49, 49' which are continually or intermittently meshed together corresponding to the particular control of the needles. These weft yarns to some extent take the place of loop yarns in conventional knitted fabrics. However, no matter whether they are meshed or not, due to the shed change of the warp yarns, they form a true weave with the latter. (See FIGS. 11A, B, C, FIGS. 12A and B and FIGS. 13A, B, and C).

The combined circular weaving-knitting machine shown in the embodiment according to FIGS. 1 through 10 has two needle beds. It will be appreciated that the machine can also be produced with one needle bed. The advantage of the machine of this invention is that the sequence of course and weft can be manipulated to produce a variety of new and different fabrics in a simplified and economical manner. For example, every yarn insertion followed by a needle operation results in no weft, and every other yarn insertion followed by a needle operation results in alternate wefts and courses. In addition, due to the relatively limited stressing of the individual weft or warp yarns, there is almost no restriction to the selection of material and yarn number, i.e. a relatively large number of yarn types can be used.

Figure 2C:
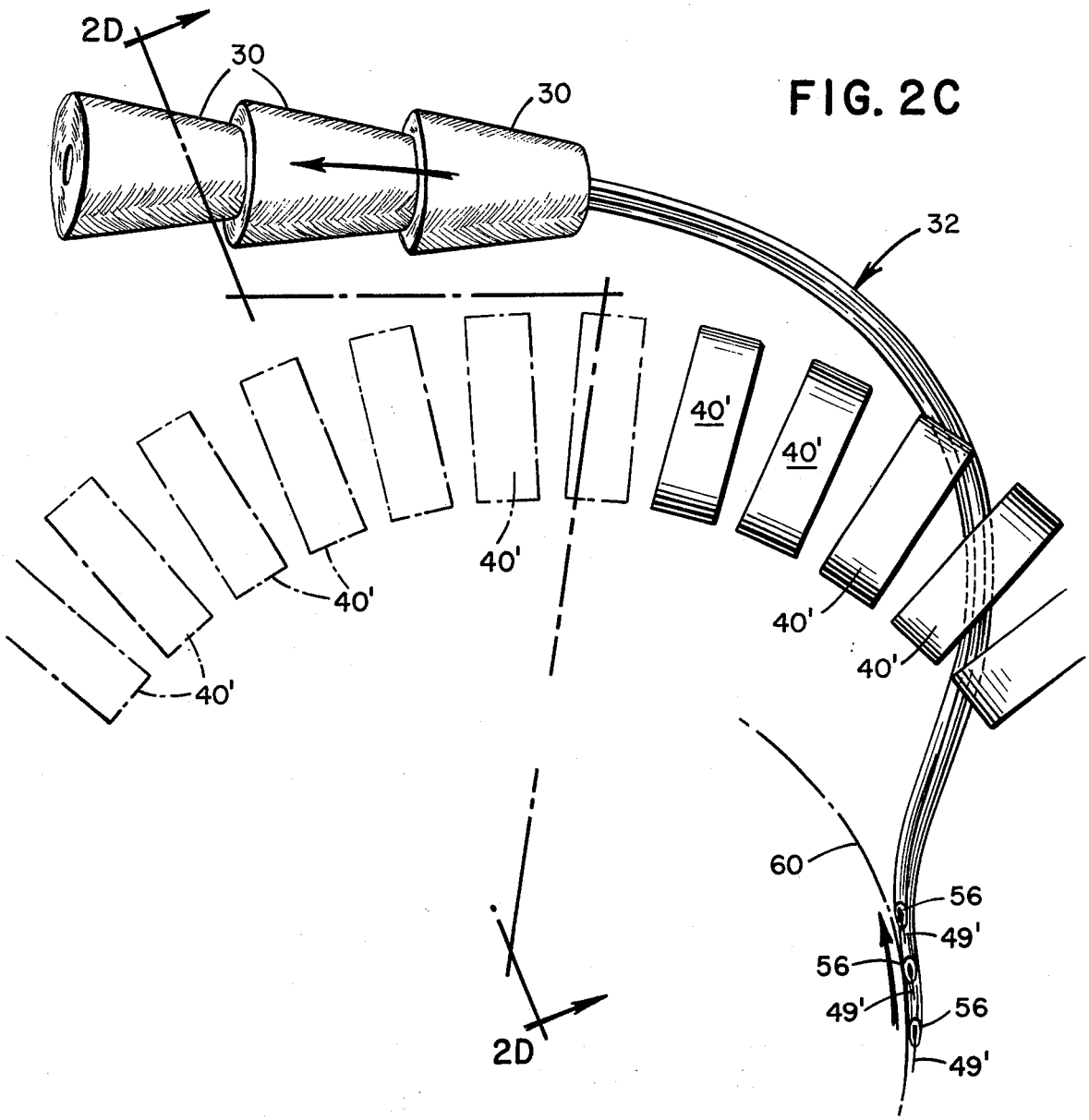
FIGS. 2C and D show a top view and a side view schematically of a modification of the bow arrangement for the weft yarn insertion of three different yarns into the same shed.
Figure 2D:
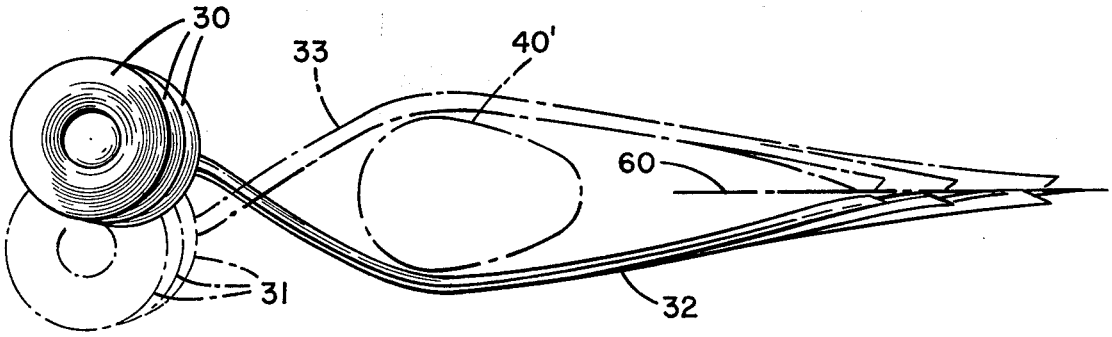

Furthermore, in this machine the sequence of mesh row or course, weft yarn and shed change can be programmed to be varied randomly as desired. In addition several yarns can be supplied simultaneously by a single insertion bow of the weaving-knitting line whereby the yarns emerge from separate staggered outlets (see FIGS. 2C and D), and depending on the control exercised on the dial or cylinder needles, yarns can be inserted meshed or knitted together as desired leading to a varied weave. Also, various possible patterns can be combined together leading to a variety of webs with correspondingly variable characteristics such as elasticity, density or porosity and dimensional stability, and the like. For example, by a corresponding control of the dial and/or cylinder needles, it is possible for the inserted weft yarns to be either unmeshed or only partly meshed, i.e. within the meshed web at least individual peripheral portions extending over random lengths can be in woven fabric form. Examples of some of the possible fabrics that can be produced by the weaving-knitting machine of this invention are shown in FIGS. 14A and B. Advantageously, the weft yarns are under controlled tension and laid precisely in the shed during the weaving-knitting operation so that the knitting needles can perform their operation.

It will be appreciated that the fixed warp supply bobbins or means can be any mechanical fixed yarn supply arrangement in which movement of warp yarn or thread is produced so that a plurality of spaced warp yarns are continuously fed to the weaving-knitting line having a radial component of travel so that sheds can be continuously produced by the rotating insertion bows which lay-in the weft insertion yarn in each shed, whereby the yarn either remains as an insertion or is stitched according to the programming of the needle operation of the machine.

It will be appreciated that various changes and modifications may be made within the skill of the art without departing from the spirit and scope of the invention illustrated and described herein.

What is claimed is:

1. A circular weaving-knitting machine for producing textile webs, having a circular weaving portion and a circular knitting portion characterized in that the circular weaving portion of the machine has two groups of separate warp yarn supply means delivering warp yarns radially to a closed curve, upper and lower weft yarn supply means having associated therewith weft yarn insertion bows arranged in rotary manner about the closed curve for delivering weft yarns thereto, combined with a circular knitting portion having needle-containing means in which knitting needles operate to produce stitches in such a way that the weaving line of the weaving portion described by said rotating insertion bows with their yarn discharge openings corresponds with the knitting line of the knitting portion to form a common weaving-knitting line, and that the weft yarns are inserted from each insertion bow in succession by the rotation of upper and lower insertion bows in sheds which are formed from the warp yarns by the insertion bows by the synchronized driving of the circular weaving and knitting portions of the machine, said weft yarn insertions being formed into stitches as programmed by the controlled operation of the needles or retained as a weft yarn insertion.

2. A circular weaving-knitting machine for producing textile webs, having a weaving portion and a knitting portion characterized in that the weaving portion has two groups of separate warp yarn supply members arranged on a closed curve whereby each of said groups supplies a group of warp yarns, as well as upper and lower weft yarn bobbins with associated weft yarn insertion bows arranged in rotary manner parallel to the closed curve, and is combined with the knitting portion having a fixed dial, a dial frog portion driven in rotary manner and/or a fixed needle cylinder with a cylinder frog portion driven in rotary manner, in such a way that the weaving line of the weaving portion described by said rotating insertion bows with their openings corresponds with the knitting line of the knitting portion formed by the dial and cylinder needles operated by the corresponding frog portions and form a common weaving-knitting line, and that the weft yarns inserted alternately by the upper and lower insertion bows in a shed formed from the warp yarns by the rotating insertion bows can be formed into stitches by the randomly controllable engagement of the dial and cylinder needles, by the drive synchronization of the rotary parts of the weaving portion and the knitting portion.

3. The machine according to claim 1 in which the insertion bows form in each case an extension having approximately the shape of a space to be formed between a plurality of warp yarns.

4. The machine according to claim 3 in which the extension on the side facing said needles is constructed as a surface for assuring that the latches of the needles remain open during engagement of the needles with the weft yarn.

5. The machine according to claim 2 in which the ends of the rotating insertion bows supplying the weft yarns along the weaving-knitting line are guided in rotary manner and held in the correct position relative to said dial and said needle cylinder by guidance rings.

6. The machine according to claim 2 in which the rotating support members for said weft yarn bobbins fixed thereon are constructed as separate closed rings spacedly arranged in rotary manner in guides whereby one group of warp yarns is passed through the space between said closed rings.

7. The machine according to claim 1 in which the insertion bows are provided with staggered outlets for the simultaneous supplying of yarns to the weaving line at spaced intervals during the rotation of the bows.

* * * * *